US011049711B2

(12) United States Patent
Ogura et al.

(10) Patent No.: US 11,049,711 B2
(45) Date of Patent: Jun. 29, 2021

(54) ION SOURCE FOR MASS SPECTROMETER

(71) Applicants: SHIMADZU CORPORATION, Kyoto (JP); PHYTRONIX TECHNOLOGIES INC., Québec (CA)

(72) Inventors: Tairo Ogura, Kyoto (JP); Jean Lacoursiere, Québec (CA); Pierre Picard, Québec (CA)

(73) Assignees: SHIMADZU CORPORATION, Kyoto (JP); PHYTRONIX TECHNOLOGIES INC., Québec (CA)

( * ) Notice: Subject to any disclaimer, the term of this patent is extended or adjusted under 35 U.S.C. 154(b) by 61 days.

(21) Appl. No.: 16/618,660

(22) PCT Filed: Jun. 4, 2018

(86) PCT No.: PCT/US2018/035782
§ 371 (c)(1),
(2) Date: Dec. 2, 2019

(87) PCT Pub. No.: WO2018/223111
PCT Pub. Date: Dec. 6, 2018

(65) Prior Publication Data

US 2021/0151311 A1 May 20, 2021

Related U.S. Application Data

(60) Provisional application No. 62/514,817, filed on Jun. 3, 2017.

(51) Int. Cl.
*H01J 49/10* (2006.01)
*H01J 49/04* (2006.01)

(52) U.S. Cl.
CPC ..... *H01J 49/107* (2013.01); *H01J 49/049* (2013.01)

(58) Field of Classification Search
CPC ..... H01J 49/107
USPC ..... 250/423 R, 424, 423 F, 423 P
See application file for complete search history.

(56) References Cited

U.S. PATENT DOCUMENTS

| | | | | |
|---|---|---|---|---|
| 5,742,050 | A | 4/1998 | Amirav et al. | |
| 6,646,257 | B1 | 11/2003 | Fischer et al. | |
| 7,321,116 | B2 | 1/2008 | Picard et al. | |
| 7,812,308 | B2 | 10/2010 | Kobayashi | |
| 2003/0071209 | A1* | 4/2003 | Park | H01J 49/107 250/288 |

(Continued)

FOREIGN PATENT DOCUMENTS

| | | | |
|---|---|---|---|
| CN | 105308714 | A | 2/2016 |
| TW | 201327612 | A1 | 7/2013 |
| WO | 03/102537 | A2 | 12/2003 |

OTHER PUBLICATIONS

Office Action issued from Taiwanese Patent Application No. 107118996 dated Jun. 3, 2017.

(Continued)

*Primary Examiner* — Nicole M Ippolito
(74) *Attorney, Agent, or Firm* — Sughrue Mion, PLLC

(57) ABSTRACT

A mass spectrometer having a triple ionization interface for ionizing sample components is provided. The ionization interface of the mass spectrometer includes a means for ionizing sample components via electrostatic ionization, atmospheric pressure chemical ionization, and laser diode thermal desorption.

20 Claims, 16 Drawing Sheets

(56) References Cited

U.S. PATENT DOCUMENTS

| | | | | |
|---|---|---|---|---|
| 2006/0054807 | A1* | 3/2006 | Picard | H01J 49/168 250/288 |
| 2007/0007448 | A1 | 1/2007 | Wang | |
| 2008/0067348 | A1 | 3/2008 | Musselman | |
| 2010/0276584 | A1 | 11/2010 | Splendore et al. | |
| 2012/0088305 | A1* | 4/2012 | Goldman | G01N 33/92 436/71 |

OTHER PUBLICATIONS

International Search Report for PCT/US2018/035782 dated Aug. 30, 2018 (PCT/ISA/210).
Written Opinion for PCT/US2018/035782 dated Aug. 30, 2018 (PCT/ISA/210).

* cited by examiner

TOLERAN
X.XXX ±
X.X ±
PROJEC

ION SOURCE FOR MASS SPECTROMETER

This application is a National Stage of International Application No. PCT/US2018/035782 filed Jun. 4, 2018, claiming priority based on U.S. Provisional Application No. 62/514,817, filed Jun. 3, 2017.

TECHNICAL FIELD

The present invention relates to a mass spectrometer and ionization sources therefor, in particular, it relates to introducing into a mass spectrometer ionized samples ionized in an ionization interface via one or more of the following methods: thermal desorption and/or vaporization, electrospray ionization, and atmosphere pressure chemical ionization.

BACKGROUND OF THE INVENTION

Presently, a large amount of analyses are carried out by combining high resolution separation techniques and mass spectrometry. This combination of scientific instruments has become important in different domains such as those requiring a high quantity of analyses, due partly to the development of new molecules. This is particularly true for fields such as the pharmaceutical, environmental and proteomic industries.

The coupling of chromatography and mass spectrometry now achieves the highest molecular analysis performance. Different coupling and ionization techniques have been developed using liquid chromatography and mass spectrometry. A conventionally-known liquid chromatograph mass-spectrometer (LC/MS) will now be described.

In a conventionally-known LC/MS, a sample liquid is temporally separated and eluted from a column of a liquid chromatograph section. This sample is then introduced into an interface section, and is then sprayed from a spray nozzle into an ionization interface to be ionized. Fine droplets including generated ions then proceed through a tubule and are sent to a mass analysis section of the conventionally-known LC/MS.

In the aforementioned configuration of the conventionally known LC/MS, the interface section ionizes various kinds of sample components included in a sample liquid by atomizing the sample liquid by heating, high-speed gas stream, high electric field, etc. As to the ionization method, an electrospray ionization (ESI) method and an atmospheric pressure chemical ionization (APCI) method have been most widely used. These two conventional ionization methods will now be described.

FIG. 4 illustrates a configuration employing a conventionally-known ESI method. According to the ESI method, a high voltage direct current (DC) of approximately several kV is applied to a tip portion of a spray nozzle (22) in order to generate a strong non-uniform electric field. The sample liquid that has reached the tip of the spray nozzle (22) is charge-separated by this electric field, and is sprayed as micro-charged droplets into an ionization interface (21) with the assistance of a nebulizer gas blown from a nebulizer tube (not shown) placed concentrically around the spray nozzle (22). In the ionization interface (21), a heated dry gas is supplied from a dry gas supply port (28), which is placed around an inlet tube (26), which introduces ions into a mass analysis section of a mass spectrometer, by a heated gas supplier (not shown). The heated dry gas is sprayed in a mist flow and the evaporation of the solvent in droplets accordingly progresses to proceed the generation of gaseous ions.

FIG. 5 illustrates a configuration employing a conventionally-known APCI method. In the APCI method, a needle-like discharging electrode (25) is placed in front of a spray nozzle (22). A sample liquid is sprayed into a heater (29), which is placed to encircle the tip of the spray nozzle (22), by using a nebulizer gas (not shown). Consequently the solvent and the sample molecules are vaporized. The sample molecules are made to chemically react by carrier gas ions (buffer ions) generated by a corona discharge from the discharging electrode (25). Accordingly, the ionization is carried out, and the ions are introduced into the inlet tube (26).

In general, the APCI method is effective in ionizing low-polarity through middle-polarity compounds, and the ESI method is effective to ionize middle-polarity through high-polarity compounds. In addition, according to the ESI method, since multivalent ions are generated in the process of ionizing proteins or other substances, it is possible to measure compounds having several tens of thousands of molecular weights, which are beyond the upper limit of the apparatus' mass range. Therefore, both ionization methods may be used according to the kind of sample to be analyzed, the analytical objective, etc. Conventionally, in a general LC/MS, an ESI spray section and an APCI spray section can be easily changed; an analyst properly changes the spray section according to the ionization method. However, this changing operating is difficult and troublesome—this leads to decreased analytical efficiency.

Given this situation, in order to reduce the difficulty and trouble of changing the spray sections, some conventionally-proposed apparatuses have both ionization means (ESI and APCI) included in the same ionization chamber. For example, U.S. Pat. No. 6,646,257 (Patent Document 1) and Int'l Pub. Pamphlet No. 03/102537 (Patent Document 2) describe an ionization interface using a common spray nozzle for both ESI and APCI methods. With this interface, it is possible to perform ionization according to an ESI method by applying a direct current high voltage to the tip of a spray nozzle, and concurrently, it is possible to perform ionization according to an APCI method by a corona discharge by a discharging electrode placed on the tip of the spray nozzle.

Conventional apparatuses having both ionization means (ESI and APCI) in the same ionization chamber may have independent voltage sources for each of the ESI spray nozzle and the corona discharger. In such a case, at least a two-channel voltage control circuit is required. Alternatively, a high voltage may also be alternately supplied to the electrostatic spray nozzle and the corona discharger from a single power supply. In the case where a high voltage is alternately supplied, a switching circuit is required. This described configuration has the problem of increased labor and cost due to complicated circuit designs. Further, the operation of this conventionally-known apparatuses is complicated because of increased parameter options that the user must specify (the value of a voltage to be applied to both the electrostatic spray and the corona discharger, the timing for switching the voltage supply, or other options). In addition, since both of the ESI and APCI ionization methods require that droplets be dried in a mist flow, conventionally-known LC/MSs having two types of ionization means accelerate the evaporation of a solvent by blowing a heated gas. However, the quantity of heat to be supplied to droplets per unit time is relatively small when employing only an ESI ionization method. Hence, the heating means for employing an ESI ionization method is generally not sufficient for use when employing an APCI ionization method. For this reason, the ionization efficiency in APCI is enhanced by placing an extra heater in front of a spray nozzle or with other methods. However, this increases the complexity of the device, which leads to a higher production cost.

In light of the above, another type of a conventionally-known apparatus having both ionization means (ESI and APCI) in the same ionization interface has been developed, as described in U.S. Pat. No. 7,812,308 (Patent Document 3, which is incorporated in its entirety into this instant Application by reference). In this type of conventional apparatus, a single high voltage power supply supplies voltages of a same value to the electrostatic spray nozzle and the corona discharger. Such a configuration reduces labor and cost by simplifying complicated circuit designs. Such a mass spectrometer according to this conventionally-known design may simultaneously perform ionizations according to ESI and APCI; hence, it can be preferably used for a high-throughput analysis intended for diverse samples. In addition, such a conventionally-known configuration may increase the power supplied to the block heater for use during an ESI ionization method, thus removing the need for an extra heater for use during APCI ionization.

Both previously described ionization means described above contain some drawbacks however. In both of the ESI and APCI methods, a liquid mobile phase is used. The use of a liquid mobile phase may introduce cross-contamination of the samples.

Accordingly, in light of the problems discussed above, another ionization source has been developed, namely Laser Diode Thermal Desorption (LDTD), as described in U.S. Pat. No. 7,321,116 (Patent Document 4, which is incorporated in its entirety into this instant Application by reference). In a configuration employing a LDTD ionization method, samples are ionized at atmospheric pressure without the use of a mobile phase, thus significantly reducing the risk of cross-contamination.

FIG. 6 illustrates a configuration employing a conventionally known LDTD method. In the LDTD method, a needle-like discharging electrode (25) is placed in front of a transfer tube (24). A source sample which has been desorbed by heating process proceeds to elute from the transfer tube (24). The source sample is then made to chemically react via carrier gas ions (buffer ions) generated by a corona discharge from the discharging electrode (25). Accordingly, the ionization is carried out without the use of a liquid mobile phase.

While various methods have been developed to combine ESI and APCI ionization methods for use in one LC/MS apparatus, due to the vastly different nature of the sample source method used in a LDTD ionization method, no apparatus currently exists that combines ESI, APCI, and LDTD ionization methods in a single apparatus. Problems encountered in designing such an apparatus include the design of complicated wiring schemes, complicated designed of ionization interfaces that can physically fit all three previously discussed ionization methods, and increased labor and production costs. Further, since ionization interfaces of mass spectrometers are generally compact, there exists a problem of orienting different ionization sources such that no one source loses ionization efficiency. Thus, until now, if one were to employ all three types of ionization methods for use in a mass spectrometer, one would have to either use at least two apparatuses, or take apart and reconfigure a single apparatus each time an ionization method different from ESI/APCI or LDTD was used.

The present invention has been developed in view of the aforementioned problems, and the main objective thereof is to provide an LC/MS that has a triple ion source ionization interface with an electrostatic spray nozzle, a corona discharger, and a LDTD ionization apparatus, that is user-friendly, and can be produced at low cost.

SUMMARY

One aspect is a triple ionization interface for a mass spectrometer for ionizing sample components using at least one of an ESI method, an APCI method, and an LDTD method.

The preferred embodiment of the ionization interface includes: an electrostatic spray nozzle for spraying a liquid sample as charged droplets; a LDTD transfer tube for introducing into an ionization chamber a desolved sample, a corona discharger, placed in front of the electrostatic spray nozzle and the LDTD transfer tube, for generating a corona discharge for ionizing a molecule; and at least one a voltage supplier. Another aspect is a method for introducing ionized sample components into the ionization chamber using the triple ionization source by at least one of laser diode thermal desorption, electrospray ionization, and atmospheric-pressure chemical ionization Another preferred directed toward an ionization interface for a mass spectrometer ionizing sample components, said interface comprising:

- an electrostatic spray nozzle for spraying a liquid sample as charged droplets;
- a Laser Diode Thermal Desorption (LDTD) apparatus, the LDTD apparatus comprising a LDTD transfer tube for eluting a desorbed sample; and
  - a corona discharger, placed in front of the electrostatic spray nozzle and the LDTD transfer tube for ionizing a sample;

wherein the LDTD transfer tube is disposed at an angle of 45 to less than 90 degrees with respect to the corona discharger;

wherein the LDTD transfer tube is disposed within a range of 5 to 20 mm from the center of a mass spectrometer inlet tube.

In another preferred embodiment the LDTD transfer tube is disposed at an angle of 60 to 80 degrees with respect to the corona discharger, and more preferably is disposed at an angle of 70 degrees.

In another preferred embodiment the LDTD transfer tube is disposed within a range of 12.4 to 17.4 mm from the center of a mass spectrometer inlet tube, and more preferably, the LDTD transfer tube is disposed at a distance of 12.4 mm from the center of a mass spectrometer inlet tube.

DETAILED DESCRIPTION OF THE INVENTION

Hereinafter, one embodiment of the mass spectrometer (MS) containing a triple ionization interface source will be explained with reference to the figures.

Figure 2:
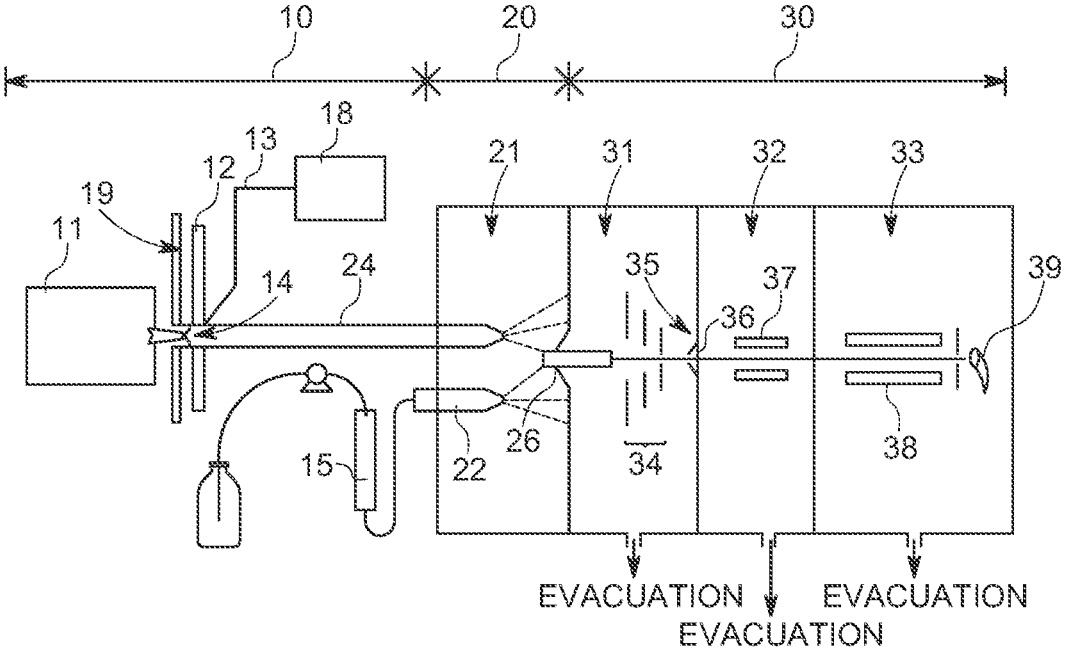
FIG. 2: is a schematic configuration illustrating a mass spectrometer containing a triple ionization interface source according to the present embodiment.

FIG. 2: is a schematic configuration illustrating a mass spectrometer (MS) containing a triple ionization source according to the present embodiment. When employing either the APCI or ESI methods of ionization in the MS, a sample liquid temporally separated and eluted from a column (15) of a liquid chromatograph section (LC section) is introduced into an interface section (atmospheric pressure ionization interface) (20), and is then sprayed from a spray nozzle (22) into an ionization interface (21) to be ionized. Fine droplets including ions generated go inside an inlet tube (tubule) (26) and are sent to a mass analysis section (MS section) (30) of the MS. The inlet tube (26) may be warmed by a heater (not shown) in certain embodiments, and the evaporation of the solvent in the droplets progresses while the solvents pass thorough inside the inlet tube (26) to further continue the generation of the target ion.

Alternatively, the MS according to the present embodiment may also employ an LDTD ionization method using an LDTD ionization source. The LDTD ionization source includes a means for heating (not shown) at least one source sample (not shown). In this exemplary embodiment, the heating means is embodied by a laser source such as a laser diode array (not shown), which generates a radiation beam (not shown). In the exemplary embodiment, the laser diode array preferably emits Infra-red light with a wavelength between 800 and 1040 nm, and preferably about 980 nm, at a power of about 1 to 50 W. The laser diode array is preferably supported by a laser case (11). A Peltier element (not shown) is advantageously used to stabilize the temperature of the laser diode array. If necessary, an optical arrangement (not shown) for directing and focusing the radiation beam may also be provided, and includes any appropriate optical component apt (not shown) to direct and focus the radiation beam.

The LDTD ionization source also includes a heat conductive sample support (12), onto which samples are loaded. The source samples are deposited onto the sample support (12), and may be adsorbed or dried thereon or adhered to the support (12) via other mechanisms. In the exemplary embodiment, the support (12) preferably has different sections each provided with a well (14). Each well (14) is adapted to receive a loaded source sample therein, so that heating each well (14) will cause the desorption of the corresponding source sample, producing a corresponding desorbed sample (not shown). The induced desorption of the loaded source sample implies that the source sample is "unloaded" by desorption and/or vaporization or another release mechanism. Preferably, the support (12) includes a main body made of polypropylene or other insulating material, and each well extends therethrough and has a front end and a back end. A sample holder (19), preferably metallic in construction, is inserted inside each well (14) and is adapted for receiving the source samples by the front end of the well (14). As the sample holder (19) in each well is surrounded by, for example, plastic, the heat conductive property of the support (12) is therefore to a large extent limited to the well (14) portions alone, and thus the heating of one source sample loaded onto one sample holder (19) does not heat adjacent source samples sufficiently to cause premature desorption of those surrounding samples.

In an exemplary embodiment, automatic loading and unloading of numerous supports (12) into and out of the rest of the apparatus is achieved by an automatic loader (not shown). For example, supports (12) each having loaded source samples thereon, can be automatically loaded and unloaded one at a time. The support (12) may be advantageously designed with the same standardization criteria (9 mm between the wells, well of 8 mm of diameter) as other similar supports available on the market. This permits the use of any automated preparation system already available on the market.

Still referring to FIG. 2, it will be noticed that the radiation beam (not shown) is directed so as to impinge on the back of the heat conductive support (12). More specifically, the radiation beam impinges the support holder (not shown) from the back end of the corresponding well (14), therefore not directly affecting the source sample which is loaded on the opposite surface of the holder (19). In this manner, the source sample is heated indirectly, and the heating process only acts to desorb the sample without ionizing it. Though partial ionization could occur upon indirectly heating the source sample via the support (12), this would be an exceptional eventuality and complete ionization would be subsequently required.

The apparatus for the LDTD ionization source further includes a transfer tube (24) having a first end and a second end. The transfer tube (24) is provided with a carrier gas flowing therethrough, which is preferably continuous. The carrier gas is provided by a carrier gas tube (13), which is connected to the first end of the transfer tube via a nozzle (not shown). The nozzle is arranged and adapted so that the carrier gas is injected into the front end of the well (14) and that the carrier gas flows through the transfer tube (24) from its first end to its second end. Preferably, the carrier gas is preheated in a gas heater (18) so that its temperature is controlled. The carrier gas may also include a reactive gas for promoting the ionization of the desorbed sample.

The transfer tube (24) is preferably provided with a means for sequentially conveying the desorbed samples towards the interface section (20). Preferably, this is achieved through the use of a piston. The transfer tube (24) may be sequentially driven by a piston (not shown) into the wells (14) to collect the desorbed samples. The transfer tube (24) may also be heated.

The desolved sample is then introduced into the interface section (atmospheric pressure ionization interface) (20), and is then introduced into the ionization interface (21) to be ionized. Fine droplets including ions generated go inside the inlet tube (tubule) (26) and are sent to a mass analysis section (MS section) (30) of the MS. Although the invention is not limited to a particular mass spectrometer, one configuration is described below.

The MS section (30) of the MS according to the instant exemplary embodiment is composed of three chambers; a first intermediate chamber (31), a second intermediate chamber (32), and an analysis chamber (33). The ionization chamber (21) and the first intermediate chamber (31) communicate with each other through the desolvation tube (26). The first intermediate chamber (31) and the second intermediate chamber (32) communicate with each other through a passage hole (orifice) (36) with a small diameter placed on the top of a conical skimmer (35). Inside the ionization chamber (21), an atmosphere is maintained at approximately atmospheric pressure. The first intermediate chamber (31) is exhausted to approximately 1 Torr by preferably, a rotary pump. The second intermediate chamber (32) and the analysis chamber (33) are respectively exhausted to approximately 10-3-10-4 Torr and to approximately 10-5-10-6 Torr by, preferably, a turbo molecular pump. The analysis chamber (33) is maintained in a high-vacuum state by heightening the degree of vacuum in a stepwise manner from the ionization interface (21) to the analysis chamber (33).

The ions that have passed through the inlet tube (26) are converged into the orifice (36) by a first ion lens (34), and pass through the orifice (36) to be introduced into the second intermediate chamber (32). The ions are then converged and accelerated by a second ion lens (37) to be sent to the analysis chamber (33). Only the target ions having a particular mass number (mass/charge) pass through the space across the long axis of a quadrupole filter (38) placed in the analysis chamber (33) and reach an ion detector (39). In the ion detector (39), a current corresponding to the number of the ions reached is taken out as a detection signal.

Figure 3A:
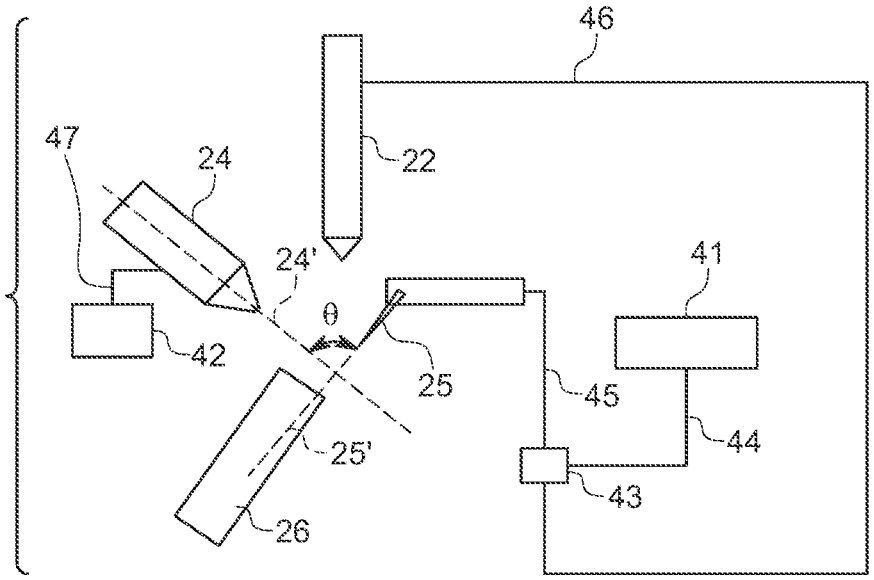
FIG. 3A is a schematic configuration of a mass spectrometer containing a triple ionization interface source according to the present embodiment.
Figure 3B:
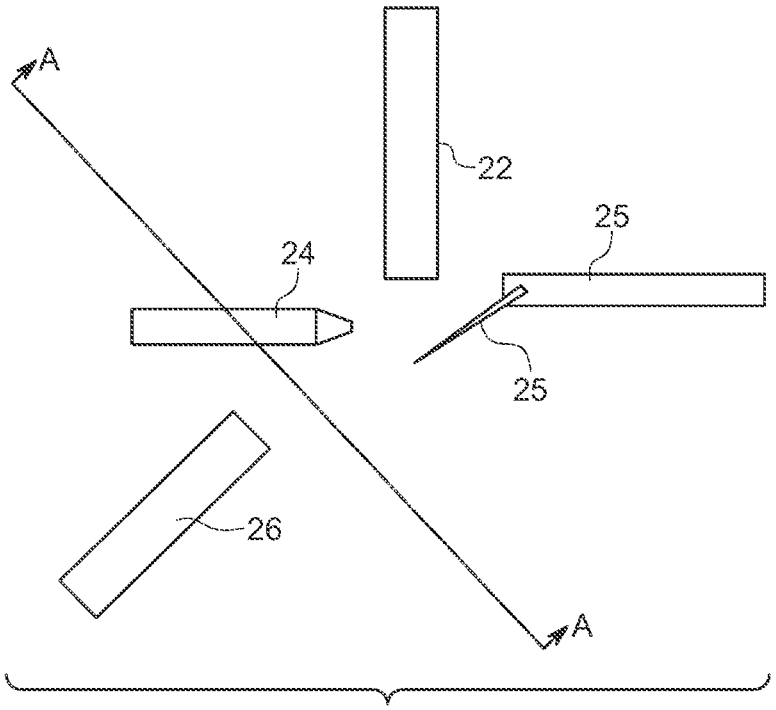
FIG. 3B is a schematic configuration of a mass spectrometer containing a triple ionization interface source according to the present embodiment.
Figure 4:
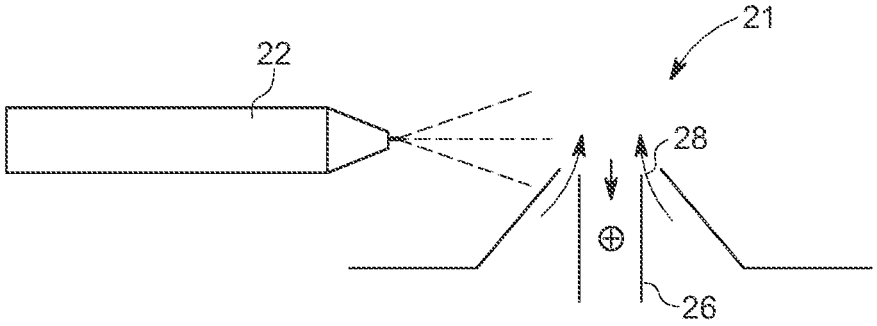
FIG. 4 RELATED ART
FIG. 4 is a schematic configuration illustrating an ESI ionization method.
Figure 5:
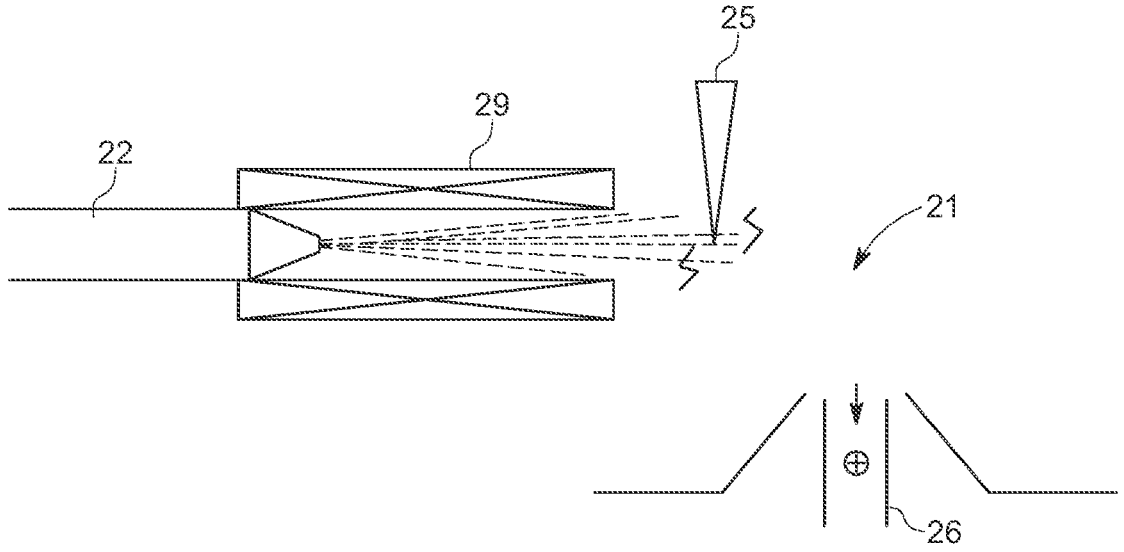
FIG. 5 is a schematic configuration illustrating an APCI ionization method.
Figure 6:
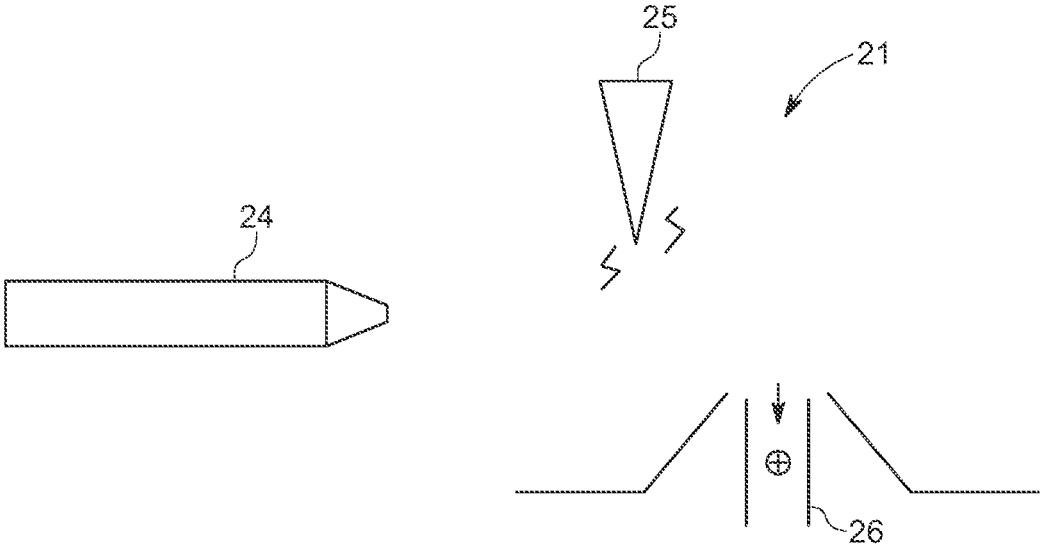
FIG. 6 RELATED ART
FIG. 6 is a schematic configuration illustrating an LDTD ionization method.

FIG. 3A is a schematic orthogonal view of the ionization interface chamber according to an exemplary embodiment, and FIG. 3B is an orthogonal view thereof. A shown in FIG. 3A, the ionization interface chamber preferably includes a discharging electrode (25) for generating a corona discharge. The discharging electrode (25) is provided at the exit of the second end of the LDTD transfer tube (24), and the exit of the nozzle (22). The discharging electrode (25) is preferably made of conductive material such as stainless steel or tungsten. In the exemplary embodiment, The discharging electrode (25) is preferably placed at an angle of 90 degrees relative to the nozzle (22). But the discharging electrode (25) may also be placed at other orientations with respect to nozzle (22). The corona discharge (0-10 kV) is carried out through via the discharging electrode (25) by a process of electronic cascades. The discharging electrode (25) is controlled by constant current mode or by constant voltage mode, and the voltage applied thereto is controlled by the mass spectrometer software or the controller (40).

Figure 7:
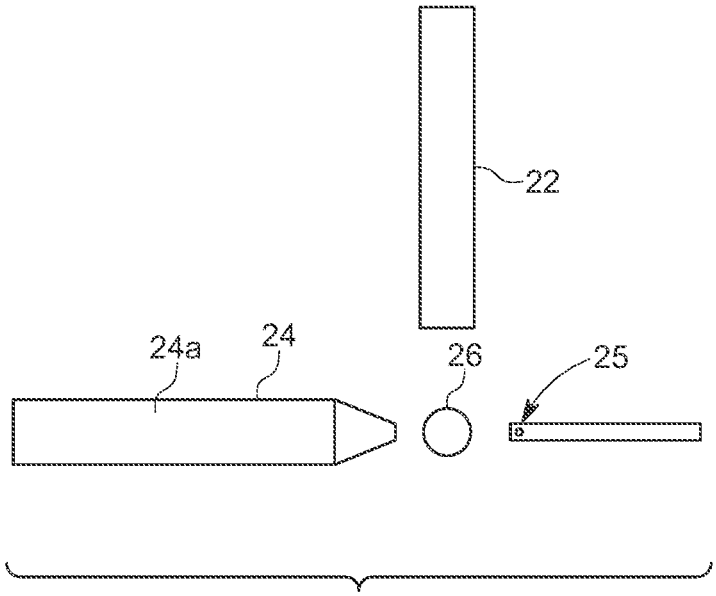
FIG. 7 is a schematic configuration of a mass spectrometer containing a triple ionization interface source according to the present embodiment taken of the view along a Y-axis and the line A-A in FIG. 3B.

FIG. 7 is a view of the ionization chamber of the preferred embodiment when viewed from the direction along which the inlet (22) projects from the ionization interface. As shown in FIG. 7, the LDTD transfer tube (24), the discharging electrode (25), and the inlet (26) are preferably in a horizontal plane. Further, the spray nozzle (22) is preferably placed in a vertical plane perpendicular to this horizontal plane.

Figure 8:
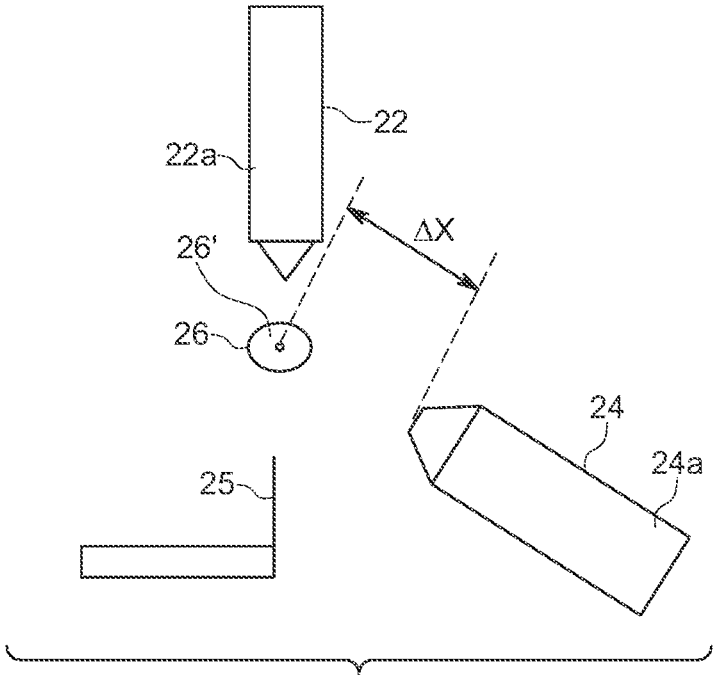
FIG. 8 is a plan view of a schematic configuration of a mass spectrometer containing a triple ionization interface source according to the present embodiment when viewed from a X-axis.
Figure 9:
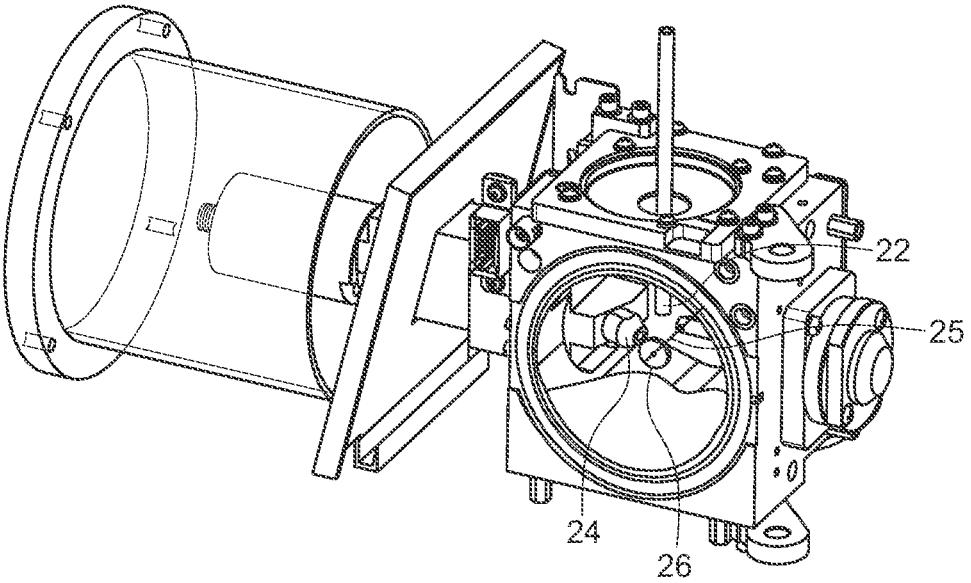
FIG. 9 is a schematic configuration of a triple ionization interface for use in a mass spectrometer according to the present embodiment.
Figure 10:
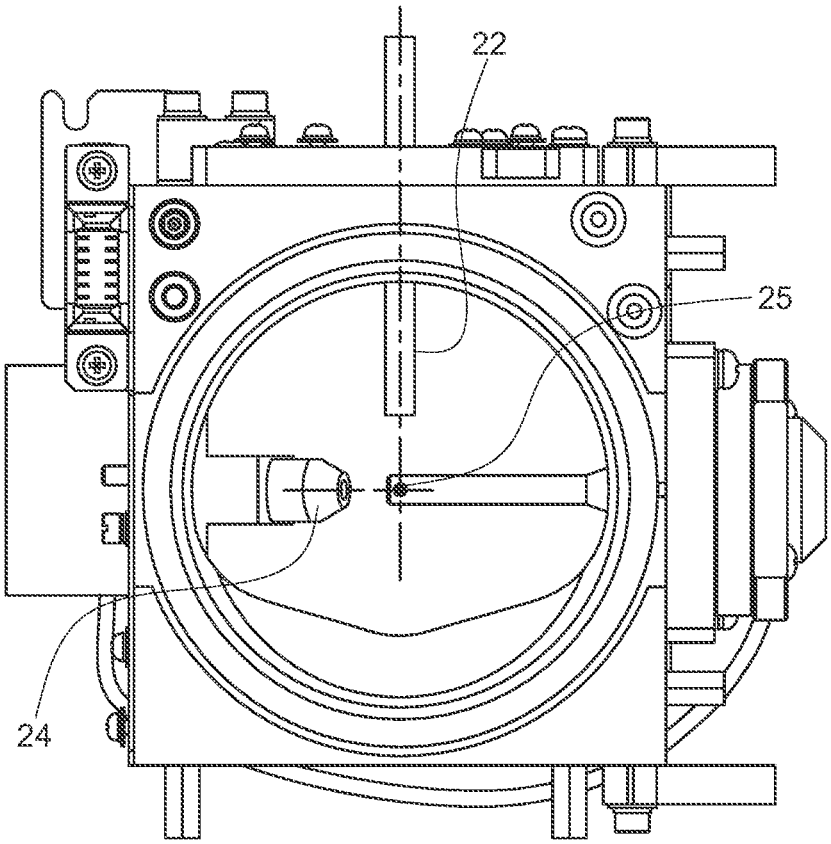
FIG. 10 is a plan view of a triple ionization interface for use in a mass spectrometer according to the present embodiment.
Figure 11:
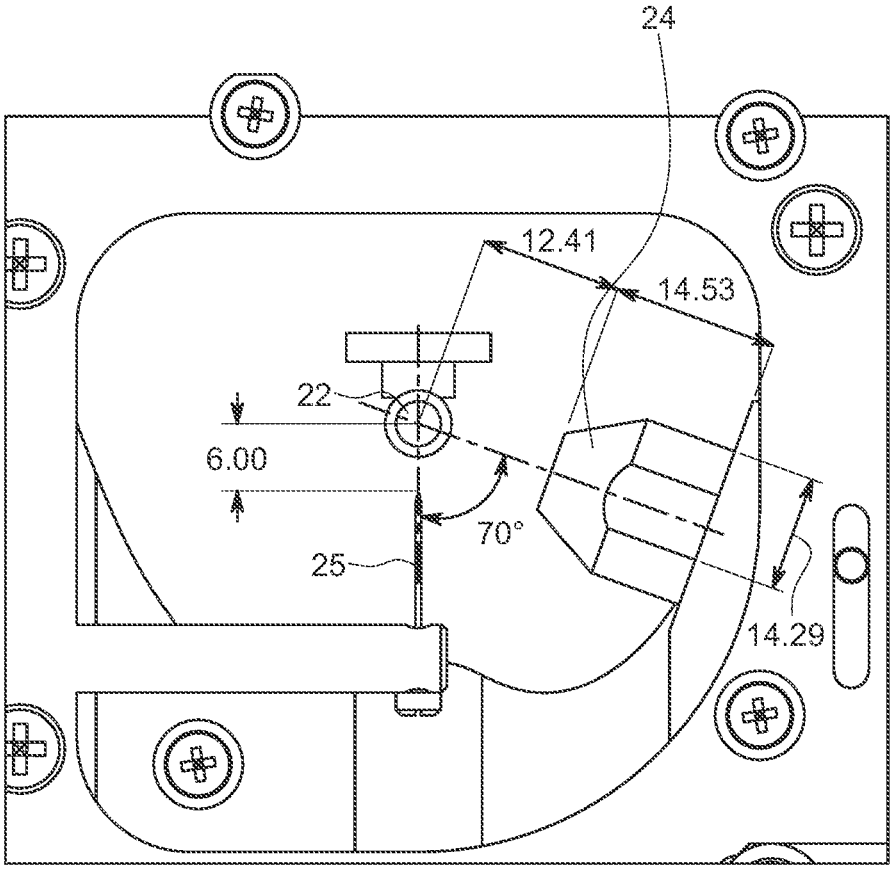
FIG. 11 is another plan view of a triple ionization interface for use in a mass spectrometer according to the present embodiment.
Figure 12:
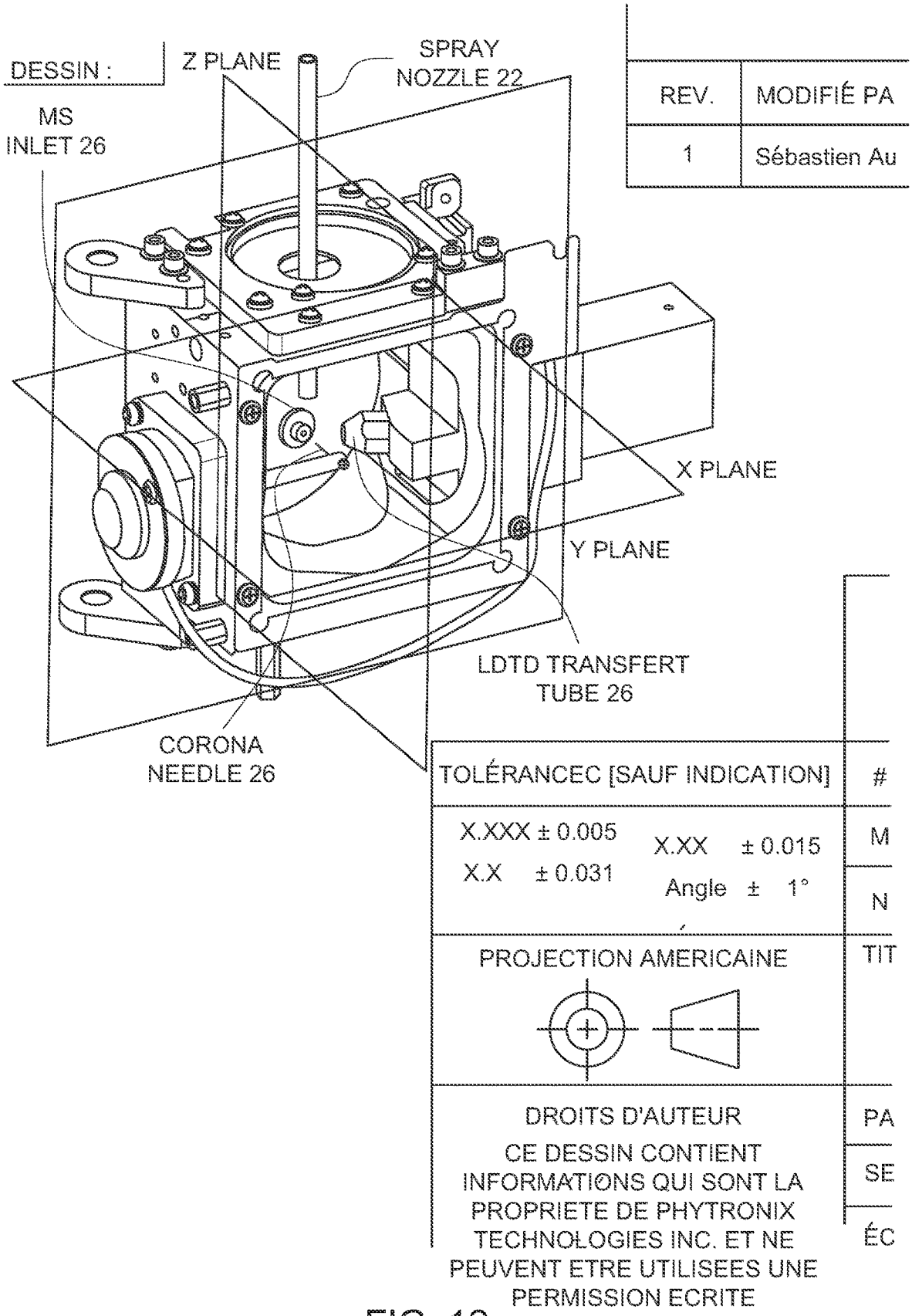
FIG. 12 is an orthogonal view of a triple ionization interface for use in a mass spectrometer according to the present embodiment.
Figure 13:
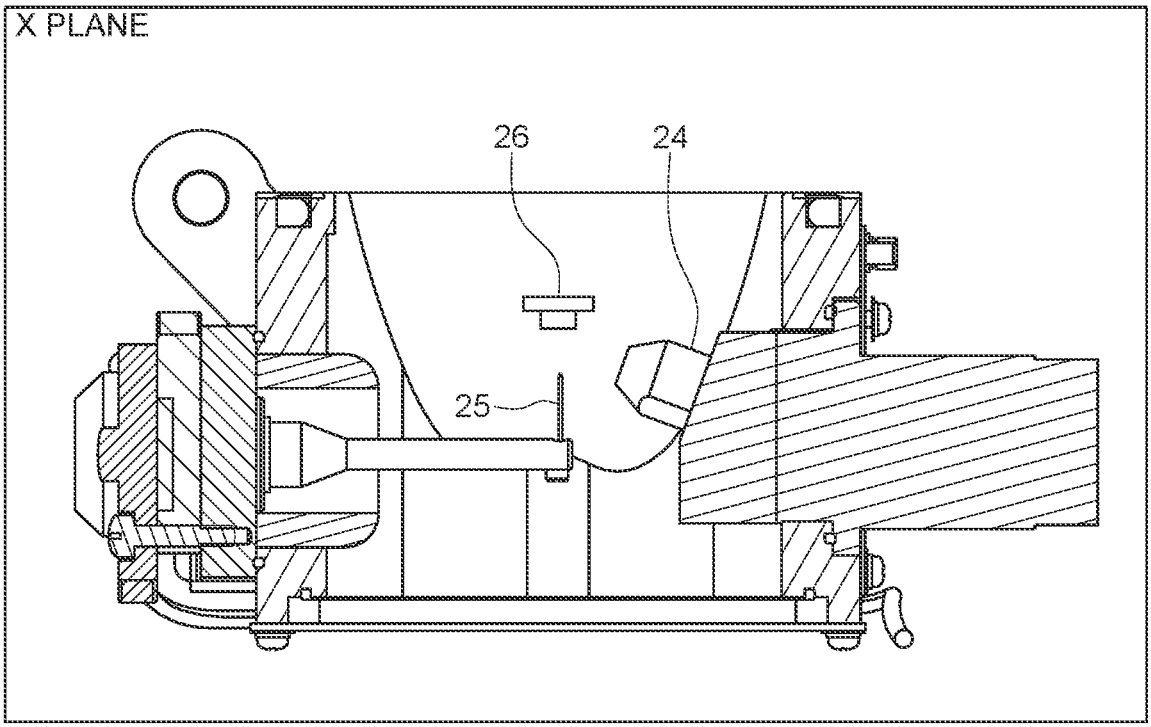
FIG. 13 is a partial view of a triple ionization interface for use in a mass spectrometer according to the present embodiment when viewed from a X-axis.
Figure 14:
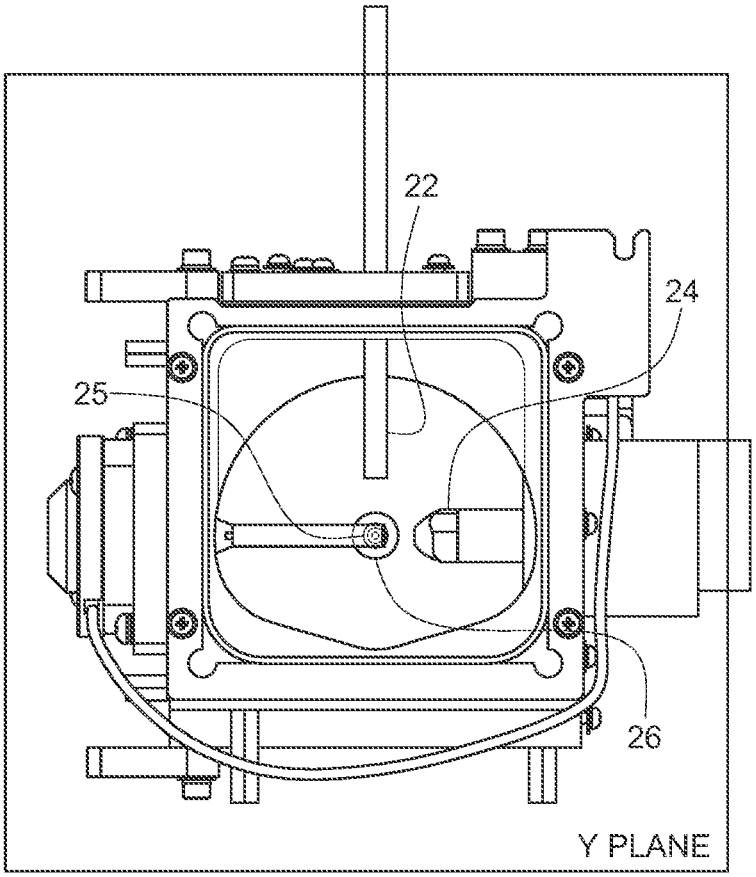
FIG. 14 is a partial view of a triple ionization interface for use in a mass spectrometer according to the present embodiment when viewed from a Y-axis.
Figure 15:
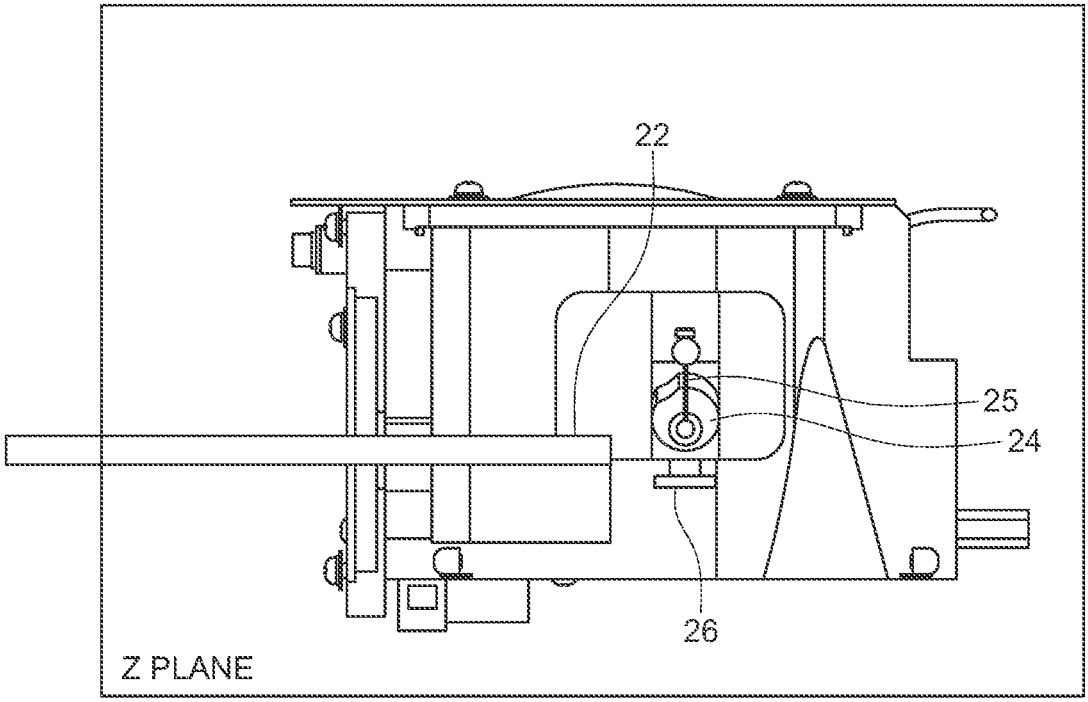
FIG. 15 is a partial view of a triple ionization interface for use in a mass spectrometer according to the present embodiment when viewed from a Z-axis.

Now referring to FIGS. 3B, 7, and 8, in the exemplary embodiment, the spray nozzle (22) is disposed perpendicularly to the plane in which the LDTD transfer tube (24), the discharging electrode (25), and the inlet tube (26) are disposed. FIG. 8 is a plan view of the ionization interface chamber according to the exemplary embodiment as viewed from the direction along which inlet (22) projects from the ionization interface chamber. As is shown in FIG. 8, the LDTD transfer tube (24) is preferable placed at an angle of 45 to less than 90 degrees away from the discharging electrode (25), and more preferable at an angle of 60 to 80 degrees from the discharging electrode (25), and even more preferably at an angle of 70 degrees with respect to the discharging electrode (25). These angles are preferable because it allows for increased ionization efficiency within the relatively small ionization chamber.

In the exemplary embodiment, as shown in FIGS. 3A and 8, the nozzle (22) preferably consists of a cylindrical base metal tube (22*a*), and a conical tip end. The LDTD transfer tube (24) also preferably consists of a cylindrical base metal tube (24*a*) with an outer diameter of approximately 14.29 mm, and a conical tip end. The tip end of the LDTD transfer tube (24) is preferably placed within a range of 5 to 20 mm from the center of the inlet tube (26), and more preferably placed within a range of 12.4 mm to 17.4, and even more preferably at a distance of 12.4 mm from the center of the inlet tube (26). The tip end of the LDTD transfer tube (24) is also preferably placed at a distance of 11.6 mm away from the discharging electrode (25). The discharging electrode (25) is preferably placed at a distance of 6 mm away from the inlet (26). These distances are preferable because they allow for increased ionization efficiency within the relatively small ionization chamber. The discharging electrode (25) preferably is formed in a cone shape. The inlet tube (26) is preferably formed in a substantially cylindrical shape.

Figure 1:
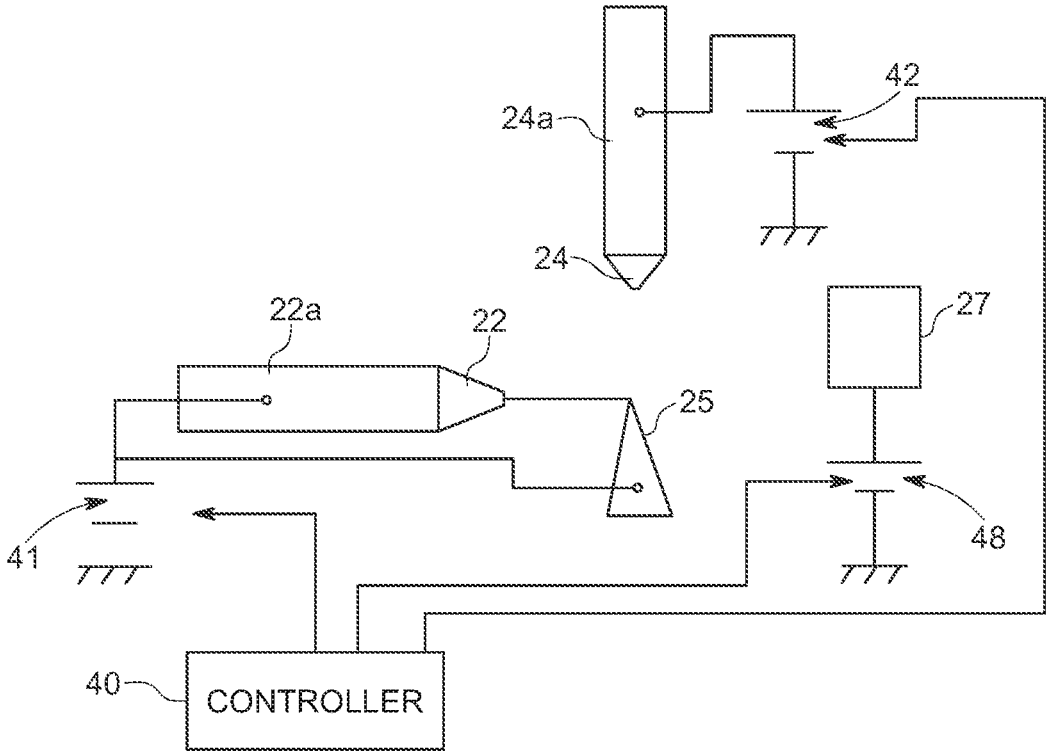
FIG. 1 is a schematic configuration diagram of a main portion of a mass spectrometer containing a triple ionization interface source according to the present embodiment.

This ionization chamber (21) can perform ionization modes according to ESI, APCI, and LDTD. That is, as illustrated in FIG. 1, which is a schematic configuration diagram of a main portion of a mass spectrometer containing a triple ionization source according to the present embodiment, a first high voltage power supply (41) for supplying a high voltage of several kV or more is connected to the spray nozzle (22) and the discharging electrode (25). Operation of the first high-voltage power supply (41) is controlled by a controller (40) for handling the MS section's general actions. A second high voltage power supply (42) is connected to the LDTD transfer tube (24). Operation of the second high voltage power supply (42) is controlled by the controller (40). The preferred embodiment may also include a block heater (27) for use during an ESI ionization. The block heater (27) is preferably connected to a power supply (48), controlled by the controller (40).

More specifically, now referring to FIG. 3A, the first high voltage power supply (41) is connected, by a feeder line (44) to a junction box (43) and also to the discharging electrode (25) via a wire (45), and the spray nozzle (22) via a wire (46). The second high voltage power supply (42) is connected to the LDTD transfer tube (24) via a wire (47).

Again referring to FIG. 3A, in the APCI method, a sample liquid from the spray nozzle (22) is made to chemically react by carrier gas ions (buffer ions) generated by a corona discharge from the discharging electrode (25). Accordingly, the ionization is carried out, and the ions are introduced into the mass analysis inlet tube (26).

It should be noted that the aforementioned embodiment is an example; changes or modifications can be properly performed within the scope of the present invention. For example, the MS section according to the mass spectrometer of the present invention may include any type of mass separator such as a time-of-flight type or other type, other than a quadrupole filter as illustrated in FIG. 2. It is also possible to bifurcate the feeder line from the high-voltage power supply and make it directly connect to the electrostatic spray and the corona discharger, without a junction box as previously described.

REFERENCE NUMERALS

11: Laser Case;
12: Sample Support;
13: Carrier Gas Tube;
14: Well;
15: Column;
18: Gas Heater,
19: Sample Holder;
20: Interface Section;
21: Ionization Interface Chamber;
22*a*: Metal Tube;
22: Spray Nozzle for APCI and ECI Ionization;
24: LTDT Transfer Tube;
24*a*: Metal Tube;
25: Discharging Electrode;
26: Mass Analysis Inlet Tube;
27: Block Heater
28: Dry Gas supply Port
29: Heater;
30: MS Section;
31: First Intermediate Chamber
32: Second Intermediate Chamber,
33: Analysis Section;
34: First Ion lens;
35: Skimmer
36: Orifice;
37: Second Lens Filter;
38: Quadropole Filter;
39: Ion Detector;
40: Controller;
41: First High Power voltage Supply:
42: Second High Power Voltage Supply;
43: Junction Box;
44: Wire;
45: Wire;
46: Wire;
47: Wire;
48: Power Supply

What is claimed is:

1. An ionization interface, comprising:

an inlet tube of a mass spectrometer;

an electrostatic spray nozzle for spraying a liquid sample as charged droplets;

a Laser Diode Thermal Desorption (LDTD) apparatus including an LDTD transfer tube for eluting a desorbed sample and a corona discharger for ionizing the sample that is placed in front of the electrostatic spray nozzle and the LDTD transfer tube;

wherein a longitudinal axis of the LDTD transfer tube is disposed at an angle of 45 to less than 90 degrees with respect to a longitudinal axis of the corona discharger; and wherein an end of the LDTD transfer tube is disposed within a range of 5 to 20 mm from a line extending longitudinally from the center of a cross-section of the mass spectrometer inlet tube.

2. The ionization interface for a mass spectrometer according to claim 1, wherein the longitudinal axis of the LDTD transfer tube is disposed at an angle of 60 to 80 degrees with respect to the longitudinal axis of the corona discharger.

3. The ionization interface according to claim 2, further comprising at least one a voltage supplier.

4. The ionization interface according to claim 3, wherein the at least one voltage supplier comprises a first voltage power supply for supplying a high voltage of several kV or more that is connected to the spray nozzle and the corona discharger, and a second voltage power supply that is connected to the LDTD transfer tube.

5. The ionization interface according to claim 4, further comprising a controller that controls operation of the first voltage power supply and the second voltage power supply.

6. The ionization interface according to claim 2, wherein the mass spectrometer includes an ionization chamber, at least one intermediate chamber, and an analysis chamber, the ionization interface is provided within the ionization chamber, and the mass spectrometer inlet tube connects the ionization chamber with the at least one intermediate chamber.

7. The ionization interface according to claim 1, wherein the end of the LDTD transfer tube is disposed within a range of 12.4 to 17.4 mm from the line extending longitudinally from the center of a cross-section of the mass spectrometer inlet tube.

8. The ionization interface according to claim 7, further comprising at least one a voltage supplier.

9. The ionization interface according to claim 8, wherein the at least one voltage supplier comprises a first voltage power supply for supplying a high voltage of several kV or more that is connected to the spray nozzle and the corona discharger, and a second voltage power supply that is connected to the LDTD transfer tube.

10. The ionization interface according to claim 9, further comprising a controller that controls operation of the first voltage power supply and the second voltage power supply.

11. The ionization interface according to claim 7, wherein the mass spectrometer includes an ionization chamber, at least one intermediate chamber, and an analysis chamber, the ionization interface is provided within the ionization chamber, and the mass spectrometer inlet tube connects the ionization chamber with the at least one intermediate chamber.

12. The ionization interface according to claim 1, further comprising at least one a voltage supplier.

13. The ionization interface according to claim 12, wherein the at least one voltage supplier comprises a first voltage power supply for supplying a high voltage of several kV or more that is connected to the spray nozzle and the corona discharger, and a second voltage power supply that is connected to the LDTD transfer tube.

14. The ionization interface according to claim 13, wherein the mass spectrometer includes an ionization chamber, at least one intermediate chamber, and an analysis chamber, the ionization interface is provided within the ionization chamber, and the mass spectrometer inlet tube connects the ionization chamber with the at least one intermediate chamber.

15. The ionization interface according to claim 13, further comprising a controller that controls operation of the first voltage power supply and the second voltage power supply.

16. The ionization interface according to claim 15, wherein the mass spectrometer includes an ionization chamber, at least one intermediate chamber, and an analysis chamber, the ionization interface is provided within the ionization chamber, and the mass spectrometer inlet tube connects the ionization chamber with the at least one intermediate chamber.

17. The ionization interface according to claim 12, wherein the mass spectrometer includes an ionization chamber, at least one intermediate chamber, and an analysis chamber, the ionization interface is provided within the ionization chamber, and the mass spectrometer inlet tube connects the ionization chamber with the at least one intermediate chamber.

18. The ionization interface according to claim 1, wherein the mass spectrometer includes an ionization chamber, at least one intermediate chamber, and an analysis chamber, the ionization interface is provided within the ionization chamber, and the mass spectrometer inlet tube connects the ionization chamber with the at least one intermediate chamber.

19. The ionization interface according to claim 1, wherein the end of the LDTD transfer tube is disposed within a range of 12.4 to 17.4 mm from the line extending longitudinally from the center of a cross-section of the mass spectrometer inlet tube.

20. The ionization interface according to claim 19, wherein the mass spectrometer includes an ionization chamber, at least one intermediate chamber, and an analysis chamber, the ionization interface is provided within the ionization chamber, and the mass spectrometer inlet tube connects the ionization chamber with the at least one intermediate chamber.

* * * * *